US009316034B2

(12) United States Patent
Totani

(10) Patent No.: US 9,316,034 B2
(45) Date of Patent: Apr. 19, 2016

(54) VEHICLE DOOR LOCK CONTROL DEVICE

(71) Applicant: Beat-Sonic Co., Ltd., Nisshin-shi, Aichi (JP)

(72) Inventor: Tsutomu Totani, Nisshin (JP)

(73) Assignee: Beat-Sonic Co., Ltd., Nisshin-shi, Aichi (JP)

( * ) Notice: Subject to any disclaimer, the term of this patent is extended or adjusted under 35 U.S.C. 154(b) by 400 days.

(21) Appl. No.: 14/088,643

(22) Filed: Nov. 25, 2013

(65) Prior Publication Data

US 2014/0159480 A1 Jun. 12, 2014

(30) Foreign Application Priority Data

Dec. 12, 2012 (JP) ..... 2012-271224

(51) Int. Cl.
*E05C 21/00* (2006.01)
*E05B 81/80* (2014.01)
*E05B 47/00* (2006.01)

(52) U.S. Cl.
CPC ..... *E05C 21/00* (2013.01); *E05B 81/80* (2013.01); *E05B 2047/0087* (2013.01)

(58) Field of Classification Search
CPC ..... E05B 17/005
USPC ..... 307/10.2
See application file for complete search history.

(56) References Cited

FOREIGN PATENT DOCUMENTS

| | | | |
|---|---|---|---|
| JP | 05-171851 | A | 7/1993 |
| JP | 2006-062622 | A | 3/2006 |
| JP | 2006-207147 | A | 8/2006 |
| JP | 2012-167495 | A | 9/2012 |

*Primary Examiner* — Robert Deberadinis
(74) *Attorney, Agent, or Firm* — Muncy, Geissler, Olds & Lowe, P.C.

(57) ABSTRACT

A vehicle door lock control device post-installed on a vehicle includes an unlocking relay having a fixed contact connectable to either one of an unlocking signal lead wire and a neutral lead wire via a first interrupt connection terminal and a movable contact connectable to the other of the unlocking signal lead wire and the neutral lead wire via a second interrupt connection terminal, an unlocking concealed switch mountable on vehicle body exterior, and an unlocking relay control unit connectable to a vehicle permanent power supply and connected to the concealed switch. The relay control unit controls the relay so that the movable contact is connected to the fixed contact when the concealed switch is manually operated. The interrupt connection terminals include metal needles thrust into the signal lead wire and the neutral lead wire to be connectable to the unlocking signal lead wire and the neutral lead wire, respectively.

12 Claims, 10 Drawing Sheets

VEHICLE DOOR LOCK CONTROL DEVICE

CROSS-REFERENCE TO RELATED APPLICATIONS

This application is based upon and claims the benefit of priority from the prior Japanese Patent Application No. 2012-271224 filed on Dec. 12, 2012, the entire contents of which are incorporated herein by reference.

BACKGROUND

1. Technical Field

The present disclosure relates to a vehicle door lock control device and more particularly to such a vehicle door lock device which is capable of unlocking vehicle doors without use of a key when inlock or a key locked-in state has occurred in which a driver inadvertently gets out of a vehicle with the key being left in the vehicle or when a child fiddles a remote-control key in a vehicle while waiting for parents, with the result that the vehicle doors are locked.

2. Related Art

In general, the following countermeasures are taken for a driver to cope with the key locked-in state. The driver always brings one or more duplicate keys with himself/herself or the duplicate key is retained on a safety location such as a reverse side of a bumper or fender.

Japanese Patent Application Publication Nos. JP-A-H05-171851, JP-A-2006-62622, JP-A-2006-207147 and 2012-167495 disclose respective door lock control devices which are capable of unlocking the vehicle doors quickly upon occurrence of a key locked-in state.

However, in order that occurrence of the key locked-in state may be prevented, it is difficult for the driver to acquire the habit of bringing duplicate keys with himself/herself as a countermeasure against the key locked-in state. Furthermore, the duplicate key retained on the backside of the bumper or fender is exposed to a risk of theft.

The door lock control devices disclosed by the above-mentioned documents are each equipped in a vehicle as a genuine or original system and have a complicate configuration. Moreover, the door lock control devices disclosed in these documents cannot be post-installed on existing vehicles.

SUMMARY

Therefore, an object of the disclosure is to provide a vehicle door lock control device which has a simple configuration and can readily be post-installed on existing vehicles as a measure against the key locked-in state.

The present disclosure provides a vehicle door lock control device post-installed on a vehicle including an actuator to actuate a vehicle door lock mechanism, a genuine door locking switch including a locking signal lead wire, an unlocking signal lead wire and a neutral lead wire, the locking signal lead wire and the neutral lead wire being conducted through the door locking switch or being cut off by the door locking switch, the unlocking signal lead wire and the neutral lead wire being conducted through the door locking switch or being cut off by the door locking switch, and an actuator control unit which is connected to the genuine door locking switch via the locking signal lead wire, the unlocking signal lead wire and the neutral lead wire, the actuator control unit actuating the actuator so that a door is locked when the locking signal lead wire and the neutral lead wire are conducted, the actuator control unit actuating the actuator so that the door is unlocked when the unlocking lead wire and the neutral lead wire are conducted. The vehicle door locking device includes an unlocking relay having a fixed contact connectable to either one of the unlocking signal lead wire and the neutral lead wire via a first interrupt connection terminal and a movable contact connectable to the other of the unlocking signal lead wire and the neutral lead wire via a second interrupt connection terminal, an unlocking concealed switch mountable on an exterior of a vehicle body and an unlocking relay control unit which is connectable to a permanent power supply of the vehicle and is connected to the unlocking concealed switch, the unlocking relay control unit being configured to control the unlocking relay so that the movable contact of the unlocking relay is connected to the fixed contact when the unlocking concealed switch is manually operated. In the device, the first and second interrupt connection terminals include metal needles which are thrust into the unlocking signal lead wire and the neutral lead wire thereby to be electrically connectable to the unlocking signal lead wire and the neutral lead wire, respectively.

According to the above-described construction, the movable contact of the unlocking relay is connected to the fixed contact when the unlocking concealed switch is operated upon occurrence of inlock or a key locked-in state. Since the movable and fixed contacts are connected to the unlocking signal lead wire or the neutral lead wire of the genuine door locking switch, the unlocking signal lead wire and the neutral leas wire are conducted through the door locking switch upon connection of the contacts, whereby the actuator is actuated to unlock the doors.

The unlocking concealed switch is not connected directly to the genuine door locking switch but is connected to the genuine door locking switch via the relay control unit and the relay both operating by the permanent power supply of the vehicle. Accordingly, even when a small-sized switch having a simple configuration is used as the unlocking concealed switch, the relay can operate substantially without malfunction. Thus, since a small-sized switch can be used as the unlocking concealed switch, the unlocking concealed switch can be placed not only on the reverse side of the bumper or fender but also on/in a place which only the vehicle owner can conceive, for example, the reverse side of license plate or an interior of sideview mirror. Furthermore, differing from a duplicate key, the concealed switch is hard for other persons to find. As a result, there is less possibility that the concealed switch would be misused by other persons even when mounted on the exterior of the vehicle.

Furthermore, the metal needles are used as the interrupt connection terminals. The metal needles can be thrust into the lead wire of the genuine door locking switch thereby to be electrically connectable to the lead wire. Consequently, the vehicle door lock control device can be connected to the genuine door lock switch in an interrupt manner by a simple work.

When the metal needles are released from the interrupt connection by pulling the metal needles from the lead wires of the genuine door lock switch, the lead wires can be substantially restored with only small holes, with the result that there is substantially no possibility of malfunction of the genuine door lock switch.

The disclosure also provides a vehicle door lock control device post-installed on a vehicle including an actuator to actuate a vehicle door lock mechanism, a genuine door locking switch including a locking signal lead wire, an unlocking signal lead wire and a neutral lead wire, the locking signal lead wire and the neutral lead wire being conducted through the door locking switch or being cut off by the door locking switch, the unlocking signal lead wire and the neutral lead wire being conducted through the door locking switch or being cut off by the door locking switch, and an actuator control unit which is connected to the genuine door locking switch via the locking signal lead wire, the unlocking signal lead wire and the neutral lead wire, the actuator control unit actuating the actuator so that a door is locked when the locking signal lead wire and the neutral lead wire are conducted, the actuator control unit actuating the actuator so that the door is unlocked when the unlocking lead wire and the neutral lead wire are conducted. The vehicle door locking device includes a locking relay having a fixed contact connectable to either one of the locking signal lead wire and the neutral lead wire via a first interrupt connection terminal and a movable contact connectable to the other of the locking signal lead wire and the neutral lead wire via a second interrupt connection terminal, a locking concealed switch mountable on an exterior of a vehicle body and a locking relay control unit which is connectable to a permanent power supply of the vehicle and is connected to the locking concealed switch, the locking relay control unit controlling the locking relay so that the movable contact of the locking relay is connected to the fixed contact when the locking concealed switch is manually operated. In the device, the first and second interrupt connection terminals include metal needles which are thrust into the locking signal lead wire and the neutral lead wire thereby to be electrically connectable to the locking signal lead wire and the neutral lead wire, respectively.

There is a case where a driver gets away from his/her vehicle while the vehicle is loaded with fresh vegetables and fish and an engine thereof is kept running for operation of air conditioner. There is another case where when going swimming or surfing by a vehicle, a driver has a possibility of loosing a vehicle key carried with him/her or the driver cannot find any suitable place to keep the vehicle key safe. In these or other cases, when the locking concealed switch is operated with the key being placed in the vehicle, the movable contact of the locking relay is connected to the fixed contact. The movable and fixed contacts are connected to the locking signal lead wire or the neutral lead wire of the genuine door locking switch. Accordingly, the locking signal lead wire and the neutral lead wire are conducted, so that the actuator is actuated to lock the doors.

The disclosure further provides a vehicle door lock control device post-installed on a vehicle including a genuine door locking switch supplying a door locking signal and a door unlocking signal, a genuine door locking unit having a genuine locking relay and a genuine unlocking relay and a door locking motor, the genuine locking relay being actuated to drive the door locking motor for normal rotation when the door locking signal has been supplied to the genuine door locking control unit, the genuine locking relay being actuated to drive the door locking motor for reverse rotation when the door unlocking signal has been supplied to the genuine door locking control unit. The vehicle door lock control device includes a non-genuine unlocking relay having a movable contact connectable via a first interrupt connection terminal to a first cut end of a lead wire connecting between the genuine unlocking relay and the door locking motor, the first cut end being located at the door locking motor side, a first fixed contact connectable via a second interrupt connection terminal to a second cut end of the lead wire connecting between the genuine unlocking relay and the door locking motor, the second cut end being located at the genuine unlocking relay side, and a second fixed terminal connectable to a permanent power supply of the vehicle, an unlocking concealed switch mountable on an exterior of a vehicle body and a non-genuine unlocking relay control unit which is connectable to a permanent power supply of the vehicle and connected to the unlocking concealed switch, the non-genuine unlocking relay control unit being configured to control the non-genuine unlocking relay so that the movable contact of the non-genuine unlocking relay is switched from the first fixed contact to the second fixed contact thereby to be connected to the second fixed contact when the unlocking concealed switch has been manually operated, wherein the first and second interrupt connection terminals include metal needles which are thrust into the lead wires thereby to be electrically connectable to the lead wire, respectively.

In the above-described vehicle door lock control device, the lead wire connecting between the door lock motor and the genuine unlocking relay is cut. The movable contact of the non-genuine unlocking relay is connected via the interrupt connection terminal to the cut end of the cut lead wire at the door locking motor side. Furthermore, the first fixed contact of the non-genuine unlocking relay is connected via the interrupt connection terminal to the cut end of the cut lead wire at the genuine unlocking relay.

Since the movable contact of the non-genuine unlocking relay is connected to the first fixed contact when the unlocking concealed switch is not depressed, the door-lock-motor side cut end of the lead wire connecting between the door lock motor and the genuine unlocking relay is connected via the movable and first fixed contacts of the non-genuine unlocking relay to the genuine unlocking relay side cut end of the lead wire. Accordingly, the door lock motor is driven for normal or reverse rotation according to the operation of the genuine door lock switch, whereby the doors are locked or unlocked.

Upon depression of the unlocking concealed switch, the movable contact of the non-genuine unlocking relay is switched from the first fixed contact to the second fixed contact. Consequently, the door lock motor is energized by the permanent power supply of the vehicle via the second fixed contact and the movable contact, so that the door lock motor is driven for reverse rotation with the result that the doors are unlocked.

According to the above-described vehicle door lock control device, the non-genuine unlocking relay is connected directly to the door lock motor without interposition of the genuine door locking control unit. Accordingly, for example, in a vehicle provided with a door lock motor controlled by a microcomputer, a circuit of the door locking switch is turned off when the doors are locked by an electronic key. Or, the vehicle doors cannot be unlocked in the passenger compartment for the security reasons. In these cases, the doors can be unlocked by operating the unlocking concealed switch outside the vehicle.

In one embodiment, the unlocking concealed switch has a bottom to which a double-sided adhesive tape is attached. Since the concealed switch is fixed to the exterior of the vehicle by the double-side adhesive tape, the work for mounting the concealed switch can be rendered easier.

In another embodiment, the unlocking concealed switch includes a waterproof push switch and a casing housing the waterproof push switch, and the casing is formed with a hole through which a pen tip is inserted so that the waterproof push switch is pressed. When the above-described structure is employed, the push switch is not actuated without insertion of the pen tip through the hole, with the result that malfunction of the concealed switch can be prevented.

In further another embodiment, the unlocking concealed switch includes a waterproof push switch and a casing housing the waterproof push switch, and the casing is formed with an elongate hole through which an end of a coin is inserted so that the waterproof push switch is pressed. When the above-described structure is employed, the push switch is not actuated without insertion of the coin end through the elongate hole, with the result that malfunction of the concealed switch can be prevented.

DETAILED DESCRIPTION

Figure 1:
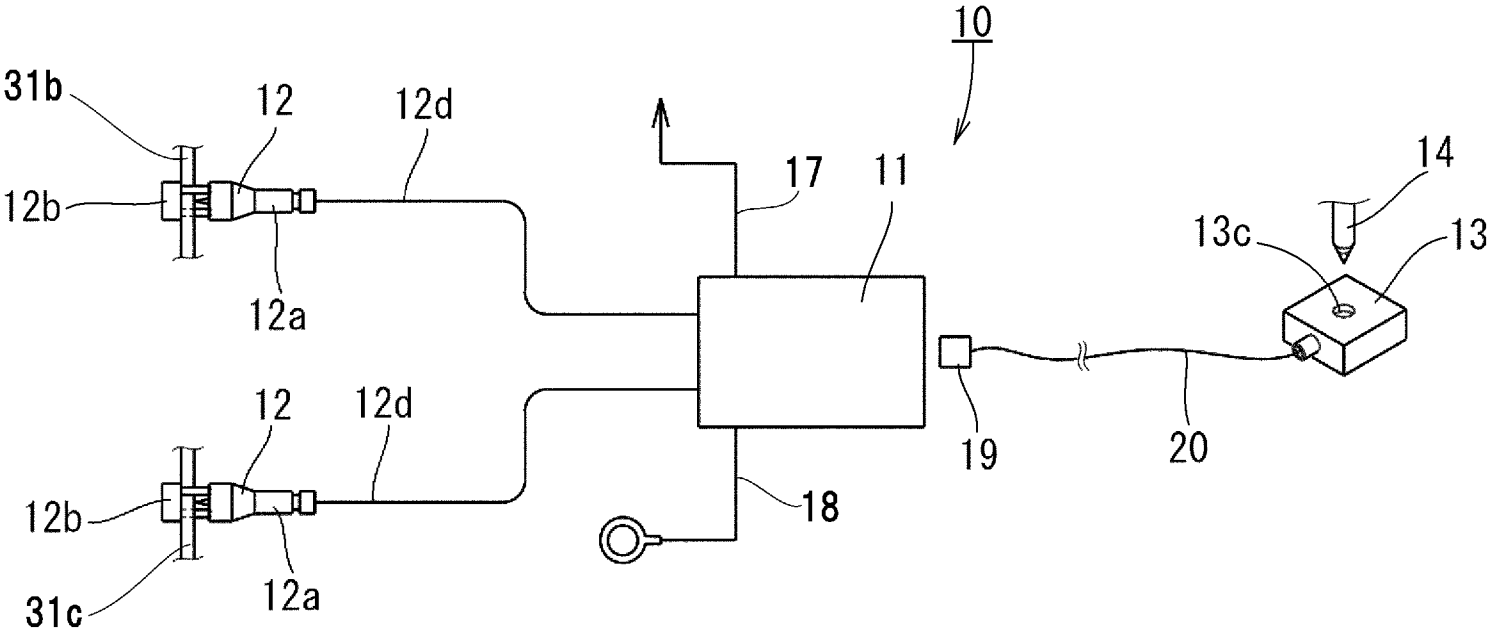
FIG. 1 is a diagrammatic view showing a functional configuration of a vehicle door lock control device of a first embodiment.

Several embodiments will be described with reference to the accompanying drawings. Referring to FIG. 1, the vehicle door lock control device 10 of a first embodiment is shown. The vehicle door lock control device 10 includes a main unit 11, a pair of interrupt connection terminals 12 and an unlocking concealed switch 13.

Figure 2:
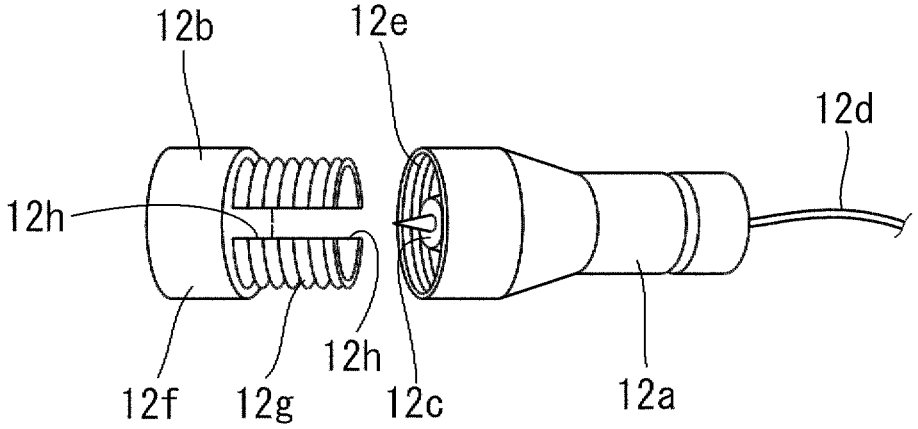
FIG. 2 is a perspective view of an interrupt connection terminal of the vehicle door lock control device.

The interrupt connection terminals 12 include cylindrical plugs 12*a* and holders 12*b*. Two electrically conductive metal needles 12*c* are fixed in the plugs 12*a*, and two lead wires 12*d* connected to the metal needles 12*c* extend out of the plugs 12*a* through open ends of the plugs 12*a*, respectively. The metal needles 12*c* project out of the plugs 12*a* through the other open ends of the plugs 12*a* respectively as shown in FIG. 2. Each one of the plugs 12*a* has a thread groove 12*e* formed in an inner periphery thereof at the other end side. Each holder 12*b* has two ends one of which is open and the other of which is formed with a knob 12*f*. The holders 12*b* have open end side outer peripheries formed with screw threads 12*g* which can be threadingly engaged with the thread grooves 12*e* of the plugs 12*a*, respectively. Furthermore, the holders 12*b* have open end side peripheries formed with two pairs of longitudinal slits 12*h* respectively. The longitudinal slots 12*h* of each pair are disposed opposite each other.

A genuine door locking switch 31, which will be described in detail later, includes three lead wires 31*a*, 31*b* and 31*c* which are inserted through the longitudinal slots 12*h* of the holders 12*b*, and the plugs 12*a* are threadingly engaged with the holders 12*b* respectively, as shown in FIGS. 1 and 2. Then distal ends of the metal needles 12*c* are thrust through tubes of the lead wires 31*a*, 31*b* and 31*c* into conductor bundles inside the tubes, so that the lead wires 31*a*, 31*b* and 31*c* fixed to the holders 12*b* are electrically connected to the lead wires 12*d* extending from the plugs 12*a* respectively.

Figure 3:
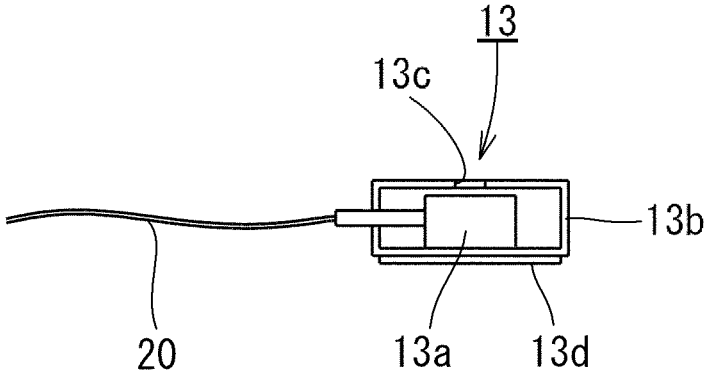
FIG. 3 is a sectional view of an unlocking concealed switch of the vehicle door lock control device.

The unlocking concealed switch 13 includes a waterproof push switch 13*a* and a casing 13*b* which houses the waterproof push switch 13*a*, and the casing 13*b* has a small hole 13*c* which is formed in an upper surface of the casing 13*b* through which a pen tip 14 of a ballpoint pen or a pencil is insertable, as shown in FIG. 3. The push switch 13*a* is depressible when the pen tip 14 is inserted through the hole 13*c*. Furthermore, the casing 13*b* has a rear side to which a double-sided adhesive tape 13*d* is attached.

Figure 4:
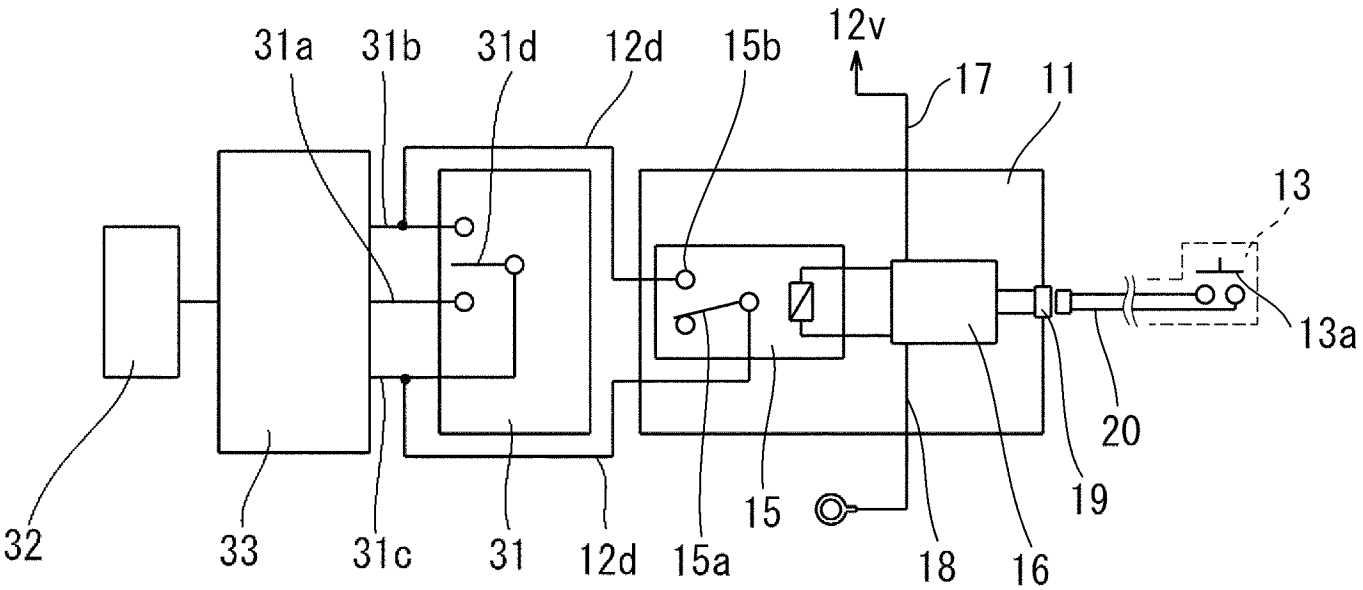
FIG. 4 is a circuit diagram of the vehicle door lock control device.

FIG. 4 shows a circuit connection configuration of the vehicle door lock control device 10 of the first embodiment and the genuine door lock switch 31 of a vehicle 30 in which the vehicle door lock device 10 is post-installed. The main unit 11 of the device 10 includes an unlocking relay 15 and an unlocking relay control circuit 16 controlling the unlocking relay. The unlocking relay control circuit 16 includes a lead wire 17 for connecting the circuit 16 to a permanent power supply of the vehicle 30 and a grounding wire 18. The unlocking concealed switch 13 can be connected via a connector 19 and a cable 20 to the unlocking relay control circuit 16.

The vehicle door lock control device 10 configured as described above is post-installed in the vehicle 30 provided with the actuator 32 for actuating a vehicle door locking mechanism, the genuine door locking switch 31 and an actuator control unit 33, as shown in FIG. 4. The genuine door locking switch 31 includes a locking signal lead wire 31*a*, an unlocking signal lead wire 31*b* and a neutral lead wire 31*c*. The genuine door locking switch 31 further includes a movable contact 31*d* through which the locking signal lead wire 31*a* and the neutral lead wire 31*c* are conducted or which cuts off the locking signal lead wire 31*a* and the neutral lead wire 31*c*. The unlocking signal lead wire 31*b* and the neutral lead wire 31*c* are also conducted through the movable contact 31*d* or are cut off by the movable contact 31*d*.

The actuator control unit 33 is connected to the genuine door locking switch 31 via the locking signal lead wire 31*a*, the unlocking signal lead wire 31*b* and the neutral lead wire 31*c*. The actuator control unit 33 is configured to actuate the actuator 32 so that the vehicle doors are locked when the locking signal lead wire 31*a* and the neutral lead wire 31*c* are conducted. The actuator control unit 33 is further configured to actuate the actuator 32 so that the vehicle doors are unlocked when the unlocking signal lead wire 31*b* and the neutral lead wire 31*c* are conducted. A door locking motor is used as the actuator 32, for example. The door locking motor is driven for normal rotation by the actuator control unit 33, thereby locking the vehicle doors. The door locking motor is driven for reverse rotation by the actuator control unit 33, thereby unlocking the vehicle doors.

Figure 5:
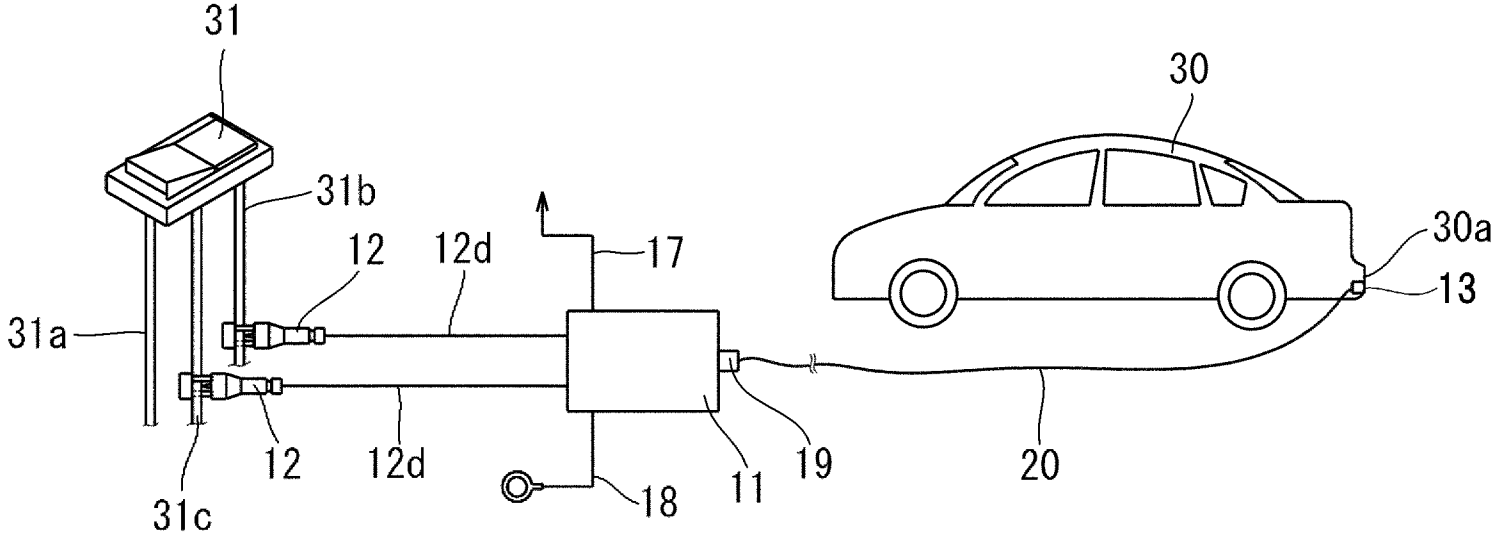
FIG. 5 is a diagrammatic view of the vehicle door lock control device, explaining the mounting of the device.

The main unit 11 of the vehicle door lock control device 10 is installed at a suitable location in a passenger compartment of the vehicle 30, and as shown in FIG. 5 the metal needle 12*c* of the interrupt connection terminal 12 is thrust into the neutral lead wire 31*c* of the genuine door locking switch 31 so that the neutral lead wire 31*c* is electrically connected to the movable contact 15*a* of the unlocking relay 15. Furthermore, the metal needle 12*c* of the interrupt connection terminal 12 is thrust into the unlocking signal lead wire 31*b* of the genuine door locking switch 31 so that the unlocking signal lead wire 31*b* is electrically connected to one of the fixed contacts 15*b* of the unlocking relay 15. The relay control circuit 16 is then connected to the permanent power supply of the vehicle 30. On the other hand, the unlocking concealed switch 13 is fixed to the reverse side of a rear bumper 30*a* by the double-sided adhesive tape 13*d* and the cable 20 is drawn into the vehicle thereby to be electrically connected via the connector 19 to the unlocking relay control circuit 16.

The movable contact 15*a* of the unlocking relay 15 is connected to the fixed contact 15*b* when the pen tip 14 of a ballpoint pen or a pencil is inserted through the hole 13*c* to depress the push switch 13*a* upon occurrence of inlock or a key locked-in state. Since the movable and fixed contacts 15*a*, 15*b* are connected to the unlocking signal lead wire 31*b* or the neutral lead wire 31*c* of the genuine door locking switch 31, the unlocking signal lead wire 31*b* and the neutral lead wire 31*c* are conducted through the connection of the contacts 15*a*, 15*b*, whereby the actuator 32 is actuated to unlock the doors.

According to the above-described vehicle door lock control device 10, a duplicate key is not attached to the exterior of the vehicle body but the unlocking concealed switch 13 is fixed to the reverse side of the rear bumper 30*a* by the double-sided adhesive tape 13*d*. Accordingly, the unlocking concealed switch 13 can be located not only on the reverse side of the rear bumper 30*a* or fender but also on/in a place which only the owner of the vehicle 30 can conceive, for example, the reverse side of license plate or an interior of sideview mirror. Furthermore, differing from a duplicate key, the concealed switch 13 is hard for other persons to find. As a result, there is less possibility that the concealed switch 13 would be misused by other persons even when mounted on the exterior of the vehicle 30.

Furthermore, the unlocking concealed switch 13 is not connected directly to the genuine door locking switch 31 but is connected to the genuine door locking switch 31 via the relay control circuit 16 and the relay 15 both operating by the permanent power supply of the vehicle 30. Accordingly, even when a small-sized push switch 13*a* having a simple configuration is used as the unlocking concealed switch 13, the relay 15 can operate without malfunction. Consequently, the small-sized push switch 13*a* can be used as the unlocking concealed switch 13. Furthermore, since the push switch 13*a* is housed in the casing 13*b* and the pen tip 14 is inserted through the small hole 13*c* to depress the push switch 13*a*, the unlocking concealed switch 13 is rendered hard for other persons to find, with the result that the safety can be improved.

The metal needles 12*c* are used as the interrupt connection terminals 12 and can be thrust into the lead wires 31*b* and 31*c* of the genuine door locking switch 31 thereby to be electrically connectable to the lead wires 31*b* and 31*c*, respectively. As a result, the vehicle door lock control device 10 can be connected to the genuine door locking switch 31 in an interrupt manner by a simple work. Furthermore, when the metal needles 12*c* are released from the interrupt connection by pulling the metal needles 12*c* from the respective lead wires 31*b* and 31*c* of the genuine door lock switch 31, the lead wires 31*b* and 31*c* can be substantially restored with only small holes, with the result that there is no possibility of malfunction of the genuine door lock switch 31.

Figure 6:
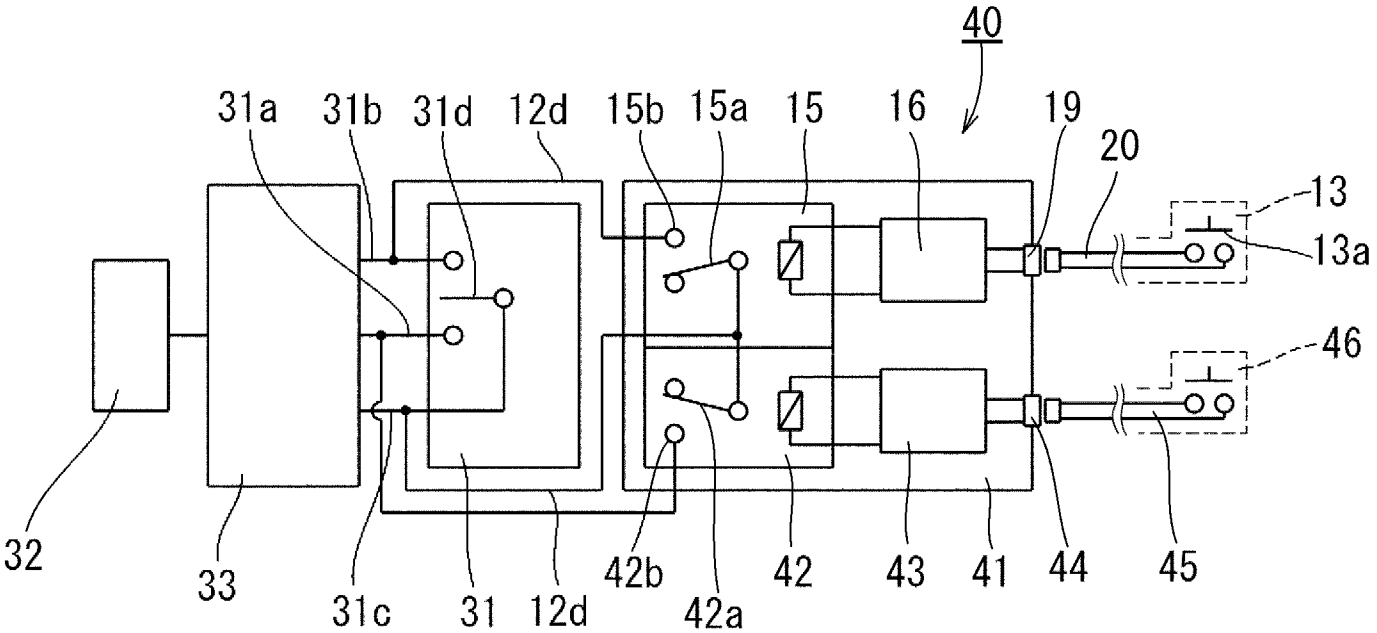
FIG. 6 is a view similar to FIG. 1, showing the vehicle door lock control device of a second embodiment.

FIG. 6 shows a circuit configuration of the vehicle door lock control device 40 of a second embodiment. The body 41 of the vehicle door lock control device 40 includes a locking relay 42 and a locking relay control circuit 43 for controlling the locking relay 42 in addition to the unlocking relay 15 and the unlocking relay control circuit 16 which controls the unlocking relay 15. A locking concealed switch 46 is connectable to the locking relay control circuit 43 via a connector 44 and a cable 45. The other configuration of the vehicle door lock control device 40 of the second embodiment is identical with that of the first embodiment. Accordingly, the identical or similar parts in the second embodiment are labeled by the same reference symbols as those in the first embodiment, and the description of these identical parts will be eliminated.

In the vehicle door lock control device 40 of the second embodiment, the metal needle 12*c* is thrust into the locking signal lead wire 31*a* of the genuine door locking switch 31 so that the locking signal lead wire 31*a* is electrically connected to the fixed contact 42*b* of the locking relay 42. The movable contact 42*a* of the locking relay 42 is connected to the lead wire 12*d* which further connects between the neutral lead wire 31*c* and the movable contact 15*a* of the unlocking relay 15. On the other hand, the locking concealed switch 46 is fixed to the reverse side of the rear bumper 30*a* by the double-side adhesive tape 13*d*. The cable 45 is drawn into the passenger compartment to be electrically connected via the connector 44 to the locking relay control circuit 43.

According to the vehicle door lock control device 40, the door unlocking concealed switch 13 is operated upon occurrence of the key locked-in state, with the result that the doors can be unlocked. Furthermore, when the locking concealed switch 46 is operated, the movable contact 42*a* of the locking relay 42 is connected to the fixed contact 42*b*. The movable contact 42*a* and the fixed contact 42*b* are connected to the neutral lead wire 31*c* and the locking signal lead wire 31*a* of the genuine door locking switch 31 respectively. As a result, when the movable contact 42*a* is connected to the fixed contact 42*b*, the locking signal lead wire 31*a* and the neutral lead wire 31*c* are conducted, so that the actuator 32 is actuated to lock the doors.

Figure 7:
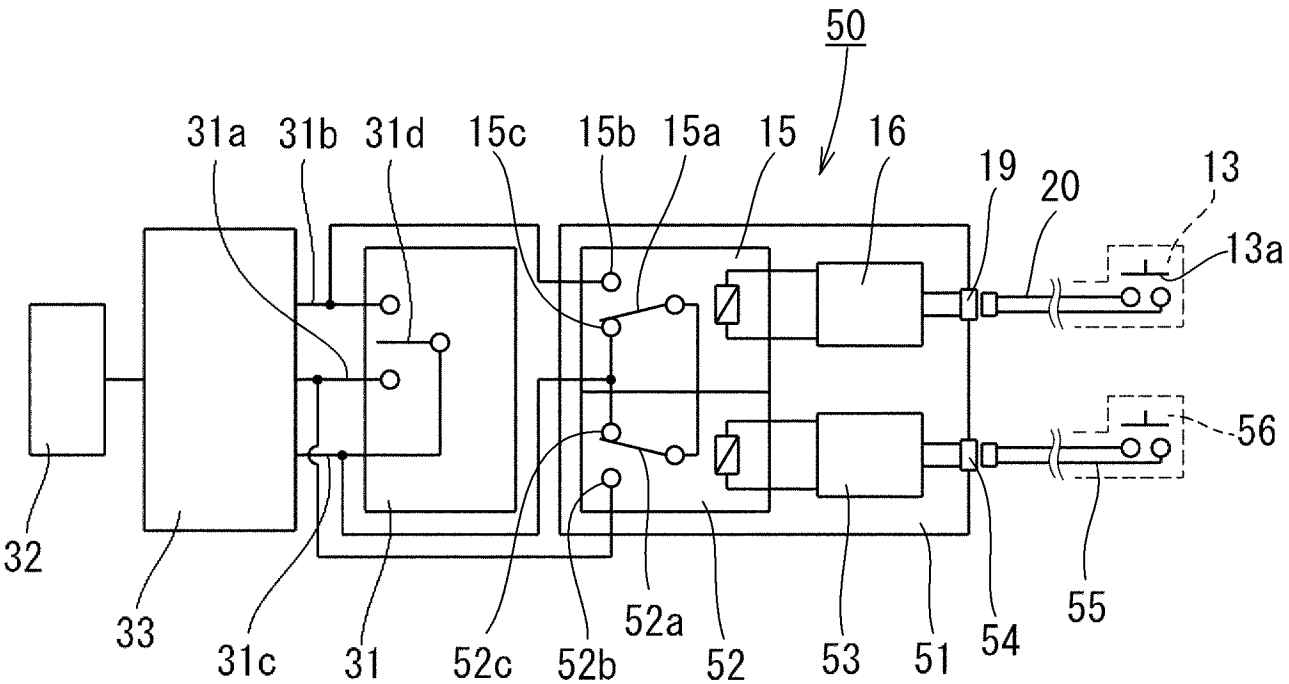
FIG. 7 is a view similar to FIG. 1, showing the vehicle door lock control device of a third embodiment.

FIG. 7 shows a vehicle door lock control device 50 of a third embodiment. The device 50 includes a main unit 51 having the door unlocking relay 15 and a door locking relay 52. One fixed contact 15*b* of the door unlocking relay 15 is connected via the interrupt connection terminal 12 to the unlocking signal lead wire 31*b* of the genuine door locking switch 31. The door locking relay 52 includes two fixed contacts 52*b* and 52*c*, and the fixed contact 52*b* is connected via the interrupt connection terminal 12 to the locking signal lead wire 31*a* of the genuine door locking switch 31.

On the other hand, the other fixed contacts 15*c* and 52*c* are connected via the interrupt connection terminal 12 to the neutral lead wire 31*c* of the genuine door locking switch 31. The movable contact 15*a* of the relay 15 and the movable contact 52*a* of the relay 52 are connected to each other. The other configuration of the vehicle door lock control device 50 of the third embodiment is identical with that of the first embodiment. Accordingly, the identical or similar parts in the third embodiment are labeled by the same reference symbols as those in the first embodiment, and the description of these identical parts will be eliminated.

In the vehicle door lock control device 50, upon operation of the unlocking concealed switch 13, the door unlocking relay 15 is actuated to connect the movable contact 15*a* to the fixed contact 15*b*. The fixed contact 15*b* is connected to the unlocking signal lead wire 31*b* of the genuine door locking switch 31 while the movable contact 15*a* is connected via the movable and fixed contacts 52*a* and 52*c* of the relay 52 to the neutral lead wire 31*c* of the genuine door locking switch 31. As a result, the unlocking signal lead wire 31*b* and the neutral lead wire 31*c* of the locking switch 31 are conducted, so that the vehicle doors are unlocked.

Upon operation of the locking concealed switch 56, the door locking relay 52 is actuated to connect the movable contact 52*a* to the fixed contact 52*b*. The fixed contact 52*b* is connected to the locking signal lead wire 31*a* of the locking switch 31, and the movable contact 52*a* is connected via the movable and fixed contacts 15*a* and 15*c* of the relay 15 to the neutral lead wire 31*c* of the locking switch 31. As a result, the locking signal and neutral lead wires 31*a* and 31*c* of the locking switch 31 are conducted, so that the doors are locked.

When the unlocking and locking concealed switches 13 and 56 are accidentally depressed simultaneously, the movable contact 15*a* of the door unlocking relay 15 is connected to the fixed contact 15*b* and at the same time, the movable contact 52*a* of the door locking relay 52 is connected to the fixed contact 52*b*. As a result, the neutral and unlocking signal lead wires 31*c* and 31*b* are cut off, and the neutral and locking signal lead wires 31*c* and 31*a* are also cut off, so that the doors neither are unlocked nor locked.

Figure 8:
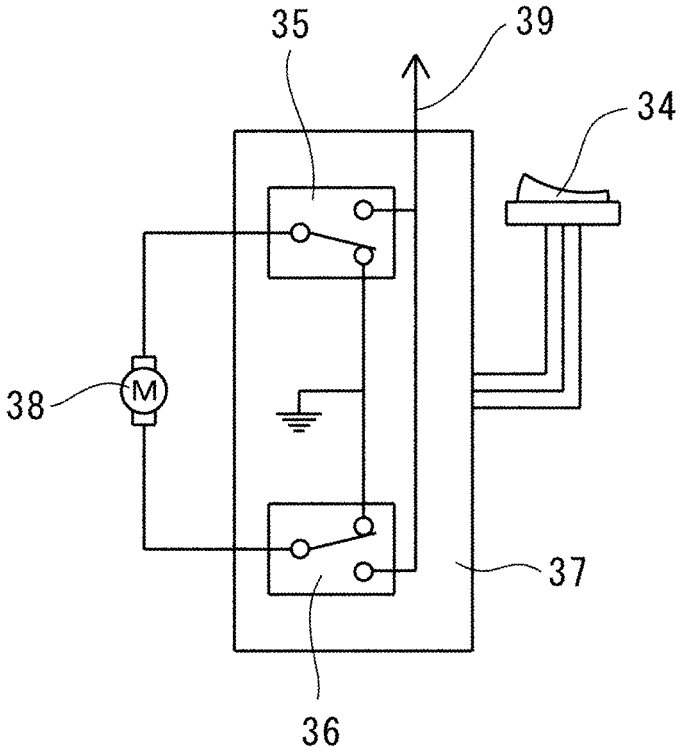
FIG. 8 is a diagrammatic view showing a functional configuration of a vehicle door lock device to which the vehicle door lock control device of a fourth embodiment is mounted.

FIG. 8 shows a functional configuration of a vehicle door locking device suitable for use with a vehicle door lock control device 70 of a fourth embodiment. The vehicle door locking device includes a genuine door locking switch 34 supplying a door locking signal and a door unlocking signal, a genuine door lock control unit 37 having a genuine locking relay 35 and a genuine unlocking relay 36, and a door locking motor 38. The genuine door locking control unit 37 is connected via a lead wire 39 to the permanent power supply of the vehicle 30. In the door locking device, when the door locking switch 34 is operated so that a door locking signal is supplied to the genuine door locking control unit 37, the genuine locking relay 35 is actuated to drive a door locking motor 38 for normal rotation, whereby the doors are locked. Furthermore, when the door locking switch 34 is operated so that a door unlocking signal is supplied to the genuine door locking control unit 37, a genuine unlocking relay 36 is actuated to drive a door locking motor 38 for reverse rotation, whereby the doors are unlocked. The genuine door locking control unit is comprised of a microcomputer.

Figure 9:
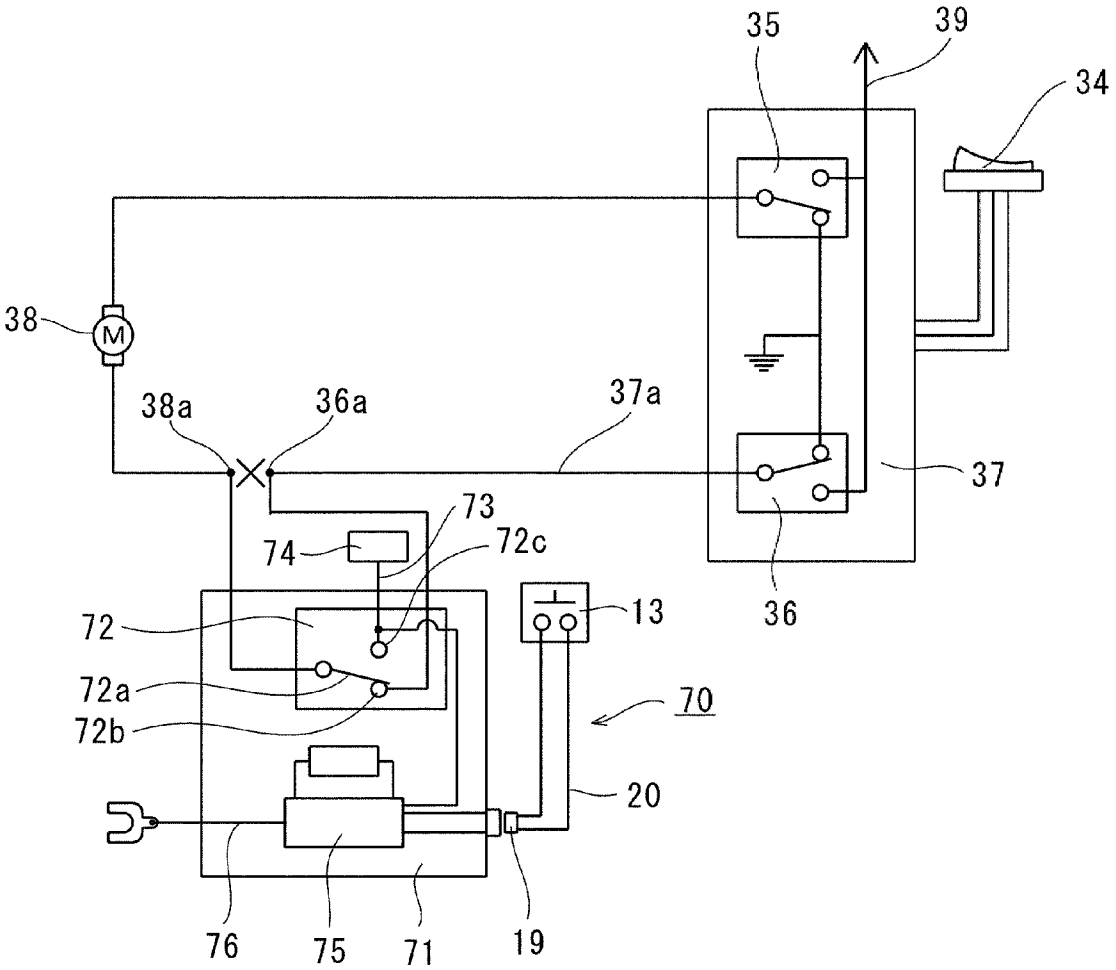
FIG. 9 is a view similar to FIG. 1, showing the vehicle door lock device of the fourth embodiment.

FIG. 9 shows a functional configuration of the vehicle door lock control device 70 of the fourth embodiment. The vehicle door lock control device 70 includes a main unit 71 and the unlocking concealed switch 13 mountable on the exterior of the vehicle body. The main unit 71 includes a non-genuine unlocking relay 72 and a non-genuine unlocking relay control circuit 75 which is connectable via a lead wire 73 to a permanent power supply 74 of the vehicle 30 and is configured to control the non-genuine unlocking relay 72.

The non-genuine unlocking relay 72 includes a movable contact 72*a*, a first fixed contact 72*b* and a second fixed contact 72*c*. A lead wire 37*a* connects between the genuine unlocking relay 36 and the door locking motor 38. The lead wire 37*a* has a cut end 38*a* located at the door locking motor 38 side. The movable contact 72*a* is connectable via the interrupt connection terminal 12 to the cut end 38*a*. The lead wire 37*a* also has a cut end 36*a* located at the genuine unlocking relay 36 side. The first fixed contact 72*b* is connected via the interrupt connection terminal 12 to the cut end 36*a*. The second fixed terminal 72*c* is connectable to the permanent power supply 74 of the vehicle 30.

The non-genuine door unlocking control circuit 75 is connectable via the lead wire 73 to the permanent power supply 74 and can be grounded via a lead wire 76. The control circuit 75 is further connected via the connector 19 and the cable 20 to the unlocking concealed switch 13. When the unlocking concealed switch 13 is manually operated, the control circuit 75 controls the non-genuine unlocking relay 72 so that the movable contact 72*a* of the relay 72 is switched from first fixed contact 72*b* to the second fixed contact 72*c*. The other configuration of the vehicle door lock control device 50 of the fourth embodiment is identical with that of the first embodiment. Accordingly, the identical or similar parts in the fourth embodiment are labeled by the same reference symbols as those in the first embodiment, and the description of these identical parts will be eliminated.

In the mounting of the vehicle door lock control device 70 on the vehicle 30, the lead wire 37*a* of the door locking motor 38 is cut, and the movable contact 72*a* of the non-genuine unlocking relay 72 is connected via the interrupt connection terminal 12 to the cut end 38*a* of the lead wire 37*a* at the door locking motor 38 side. The first fixed contact 72*b* of the relay 72 is connected via the interrupt connection terminal 12 to the cut end 36*a* of the lead wire 37*a* at the relay 72 side. The second fixed contact 72*c* of the relay 72 and the control circuit 75 are connected via the lead wire 73 to the permanent power supply 74 of the vehicle. The relay control circuit 75 is grounded via the lead wire 76. The unlocking concealed switch 13 is mounted on the exterior of the vehicle body 30.

According to the above-described vehicle door lock control device 70, when the unlocking concealed switch 13 is not depressed, the movable contact 72*a* of the relay 72 is connected to the first fixed contact 72*b*. Accordingly, both cut ends 38*a* and 36*a* of the lead wire 37*a* are connected together via the movable contact 72*a* and the first fixed contact 72*b*. As a result, the door locking motor 38 is driven for normal or reverse rotation according to the operation of the genuine door locking switch 34, so that the doors are locked or unlocked.

Upon depression of the unlocking concealed switch 13, the movable contact 72*a* of the relay 72 is switched from the first fixed contact 72*b* to the second fixed contact 72*c*. As a result, the door locking motor 38 is energized by the permanent power supply 74 thereby to be driven for reverse rotation, so that the doors are unlocked.

Figure 10:
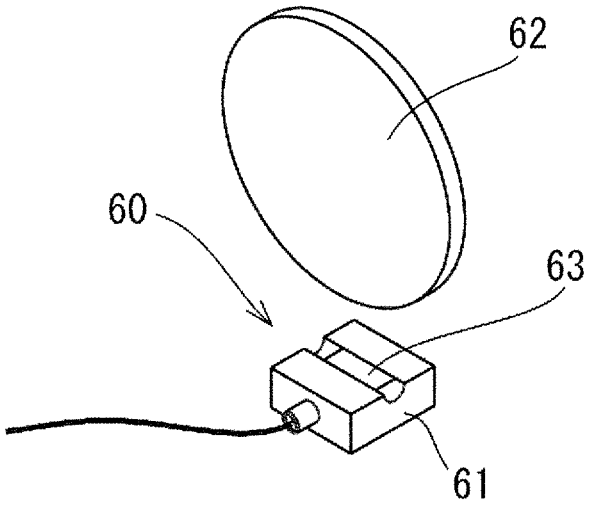
FIG. 10 is a perspective view of another embodiment of an unlocking concealed switch or a locking concealed switch.

FIG. 10 shows another form of the unlocking concealed switch 13 or the locking concealed switches 46 and 56. A switch 60 includes a casing 61 having an upper surface formed with an elongate hole 63. An end of a coin 62 is inserted through the elongate hole 63 to be depressed against the waterproof push switch housed in the casing 61. The unlocking concealed switch 13 or the locking concealed switches 46 and 56 are convenient since these switches can be depressed by the coin 62 the driver usually carries with himself/herself.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A vehicle door lock control device post-installed on a vehicle including an actuator to actuate a vehicle door lock mechanism, a genuine door locking switch including a locking signal lead wire, an unlocking signal lead wire and a neutral lead wire, the locking signal lead wire and the neutral lead wire being conducted through the door locking switch or being cut off by the door locking switch, the unlocking signal lead wire and the neutral lead wire being conducted through the door locking switch or being cut off by the door locking switch, and an actuator control unit which is connected to the genuine door locking switch via the locking signal lead wire, the unlocking signal lead wire and the neutral lead wire, the actuator control unit actuating the actuator so that a door is locked when the locking signal lead wire and the neutral lead wire are conducted, the actuator control unit actuating the actuator so that the door is unlocked when the unlocking lead wire and the neutral lead wire are conducted, the vehicle door locking device comprising:

an unlocking relay having a fixed contact connectable to either one of the unlocking signal lead wire and the neutral lead wire via a first interrupt connection terminal and a movable contact connectable to the other of the unlocking signal lead wire and the neutral lead wire via a second interrupt connection terminal;

an unlocking concealed switch mountable on an exterior of a vehicle body; and an unlocking relay control unit which is connectable to a permanent power supply of the vehicle and is connected to the unlocking concealed switch, the unlocking relay control unit being configured to control the unlocking relay so that the movable contact of the unlocking relay is connected to the fixed contact when the unlocking concealed switch is manually operated, wherein the first and second interrupt connection terminals include metal needles which are thrust into the unlocking signal lead wire and the neutral lead wire thereby to be electrically connectable to the unlocking signal lead wire and the neutral lead wire, respectively.

2. The vehicle door lock control device according to claim 1, wherein the unlocking concealed switch has a bottom to which a double-sided adhesive tape is attached.

3. The vehicle door lock control device according to claim 1, wherein the unlocking concealed switch includes a waterproof push switch and a casing housing the waterproof push switch, and the casing is formed with a hole through which a pen tip is inserted so that the waterproof push switch is depressible.

4. The vehicle door lock control device according to claim 1, wherein the unlocking concealed switch includes a waterproof push switch and a casing housing the waterproof push switch, and the casing is formed with an elongate hole through which an end of a coin is inserted so that the waterproof push switch is depressible.

5. A vehicle door lock control device post-installed on a vehicle including an actuator to actuate a vehicle door lock mechanism; a genuine door locking switch including a locking signal lead wire, an unlocking signal lead wire and a neutral lead wire, the locking signal lead wire and the neutral lead wire being conducted through the door locking switch or being cut off by the door locking switch, the unlocking signal lead wire and the neutral lead wire being conducted through the door locking switch or being cut off by the door locking switch, and an actuator control unit which is connected to the genuine door locking switch via the locking signal lead wire, the unlocking signal lead wire and the neutral lead wire, the actuator control unit actuating the actuator so that a door is locked when the locking signal lead wire and the neutral lead wire are conducted, the actuator control unit actuating the actuator so that the door is unlocked when the unlocking lead wire and the neutral lead wire are conducted, the vehicle door locking device comprising:

a locking relay having a fixed contact connectable to either one of the locking signal lead wire and the neutral lead wire via a first interrupt connection terminal and a movable contact connectable to the other of the locking signal lead wire and the neutral lead wire via a second interrupt connection terminal;

a locking concealed switch mountable on an exterior of a vehicle body; and a locking relay control unit which is connectable to a permanent power supply of the vehicle and is connected to the locking concealed switch, the locking relay control unit controlling the locking relay so that the movable contact of the locking relay is connected to the fixed contact when the locking concealed switch is manually operated, wherein the first and second interrupt connection terminals include metal needles which are thrust into the locking signal lead wire and the neutral lead wire thereby to be electrically connectable to the locking signal lead wire and the neutral lead wire, respectively.

6. The vehicle door lock control device according to claim 5, wherein the locking concealed switch has a bottom to which a double-sided adhesive tape is attached.

7. The vehicle door lock control device according to claim 5, wherein the locking concealed switch includes a waterproof push switch and a casing housing the waterproof push switch, and the casing is formed with a hole through which a pen tip is inserted so that the waterproof push switch is depressible.

8. The vehicle door lock control device according to claim 5, wherein the locking concealed switch includes a waterproof push switch and a casing housing the waterproof push switch, and the casing is formed with an elongate hole through which an end of a coin is inserted so that the waterproof push switch is depressible.

9. A vehicle door lock control device post-installed on a vehicle including a genuine door locking switch supplying a door locking signal and a door unlocking signal, a genuine door locking unit having a genuine locking relay and a genuine unlocking relay and a door locking motor, the genuine locking relay being actuated to drive the door locking motor for normal rotation when the door locking signal has been supplied to the genuine door locking control unit, the genuine unlocking relay being actuated to drive the door locking motor for reverse rotation when the door unlocking signal has been supplied to the genuine door locking control unit, the vehicle door lock control device comprising:

a non-genuine unlocking relay having a movable contact connectable via a first interrupt connection terminal to a first cut end of a lead wire connecting between the genuine unlocking relay and the door locking motor, the first cut end being located at the door locking motor side, a first fixed contact connectable via a second interrupt connection terminal to a second cut end of the lead wire connecting between the genuine unlocking relay and the door locking motor, the second cut end being located at the genuine unlocking relay side, and a second fixed terminal connectable to a permanent power supply of the vehicle;

an unlocking concealed switch mountable on an exterior of a vehicle body; and a non-genuine unlocking relay control unit which is connectable to a permanent power supply of the vehicle and connected to the unlocking concealed switch, the non-genuine unlocking relay control unit being configured to control the non-genuine unlocking relay so that the movable contact of the non-genuine unlocking relay is switched from the first fixed contact to the second fixed contact thereby to be connected to the second fixed contact when the unlocking concealed switch has been manually operated, wherein the first and second interrupt connection terminals include metal needles which are thrust into the lead wires thereby to be electrically connectable to the lead wire, respectively.

10. The vehicle door lock control device according to claim 9, wherein the unlocking concealed switch has a bottom to which a double-sided adhesive tape is attached.

11. The vehicle door lock control device according to claim 9, wherein the unlocking concealed switch includes a waterproof push switch and a casing housing the waterproof push switch, and the casing is formed with a hole through which a pen tip is inserted so that the waterproof push switch is depressible.

12. The vehicle door lock control device according to claim 9, wherein the unlocking concealed switch includes a waterproof push switch and a casing housing the waterproof push switch, and the casing is formed with an elongate hole through which an end of a coin is inserted so that the waterproof push switch is depressible.

* * * * *